US008662912B2

(12) United States Patent
He et al.

(10) Patent No.: US 8,662,912 B2
(45) Date of Patent: Mar. 4, 2014

(54) RJ-TYPE PLUG AND CONNECTOR ASSEMBLY USING THE SAME

(75) Inventors: Lu He, Shenzhen (CN); Yun-Shan Xiao, Shenzhen (CN)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 64 days.

(21) Appl. No.: 13/337,059

(22) Filed: Dec. 24, 2011

(65) Prior Publication Data

US 2013/0012050 A1 Jan. 10, 2013

(30) Foreign Application Priority Data

Jul. 8, 2011 (CN) ..... 2011 1 0191121

(51) Int. Cl.
*H01R 13/625* (2006.01)

(52) U.S. Cl.
USPC ..... 439/344; 439/676

(58) Field of Classification Search
USPC ..... 439/344, 350, 353, 354, 357, 358, 676, 439/941
See application file for complete search history.

(56) References Cited

U.S. PATENT DOCUMENTS

| | | | | | |
|---|---|---|---|---|---|
| 4,428,636 | A * | 1/1984 | Kam et al. | ..... | 439/404 |
| 5,993,237 | A * | 11/1999 | Kern et al. | ..... | 439/344 |
| 6,322,386 | B1 * | 11/2001 | Tharp et al. | ..... | 439/344 |
| 6,364,685 | B1 * | 4/2002 | Manning | ..... | 439/357 |
| 6,398,576 | B1 * | 6/2002 | Hwang et al. | ..... | 439/354 |
| 6,506,070 | B1 * | 1/2003 | Huang | ..... | 439/352 |
| 6,568,965 | B2 * | 5/2003 | Pocrass | ..... | 439/676 |
| 6,866,532 | B1 * | 3/2005 | Huang | ..... | 439/344 |
| 7,029,311 | B2 * | 4/2006 | Peloza | ..... | 439/357 |
| 7,101,212 | B1 * | 9/2006 | Larkin | ..... | 439/344 |
| 7,204,721 | B2 * | 4/2007 | Lundholm et al. | ..... | 439/676 |
| 7,329,137 | B2 * | 2/2008 | Martin et al. | ..... | 439/344 |
| 7,435,142 | B1 * | 10/2008 | Hsu | ..... | 439/676 |
| 7,883,354 | B1 * | 2/2011 | Ma et al. | ..... | 439/418 |

* cited by examiner

*Primary Examiner* — Thanh Tam Le
(74) *Attorney, Agent, or Firm* — Altis Law Group, Inc.

(57) ABSTRACT

An RJ-type plug mating with an RJ-type housing includes a plug body. The plug body includes a latching block and a latching beam respectively protruding from two opposite surfaces thereof. The latching block includes a resisting end connecting to the first surface, a front end opposite to the resisting end, and a guiding surface connecting the resisting end and the front end. The guiding surface is operable to guide the latching block to be latched into or be separated from a top of the RJ-type housing. The latching beam is operable to latch a bottom of the RJ-type housing.

15 Claims, 6 Drawing Sheets

RJ-TYPE PLUG AND CONNECTOR ASSEMBLY USING THE SAME

BACKGROUND

1. Technical Field

The present disclosure generally relates to plugs and, particularly, to an RJ-type plug and a connector assembly using the RJ-type plug.

2. Description of Related Art

RJ-type plugs (e.g., RJ-45 plug or RJ-11 plug) are usually used to connect cables to a corresponding RJ-type housing. A typical RJ-type plug usually has an elastic arm protruding therefrom. The elastic arm is latched into the RJ-type housing to connect the RJ-type plug to the RJ-type housing.

However, the elastic arm is usually very thin and is easily broken after a period of time of use.

Therefore, there is room for improvement within the art.

BRIEF DESCRIPTION OF THE DRAWINGS

Many aspects of the disclosed RJ-type plug and connector assembly using the RJ-type plug can be better understood with reference to the following drawings. The components in the drawings are not necessarily drawn to scale, the emphasis instead being placed upon clearly illustrating the principles of the present RJ-type plug and connector assembly using the RJ-type plug.

DETAILED DESCRIPTION

Figure 1:
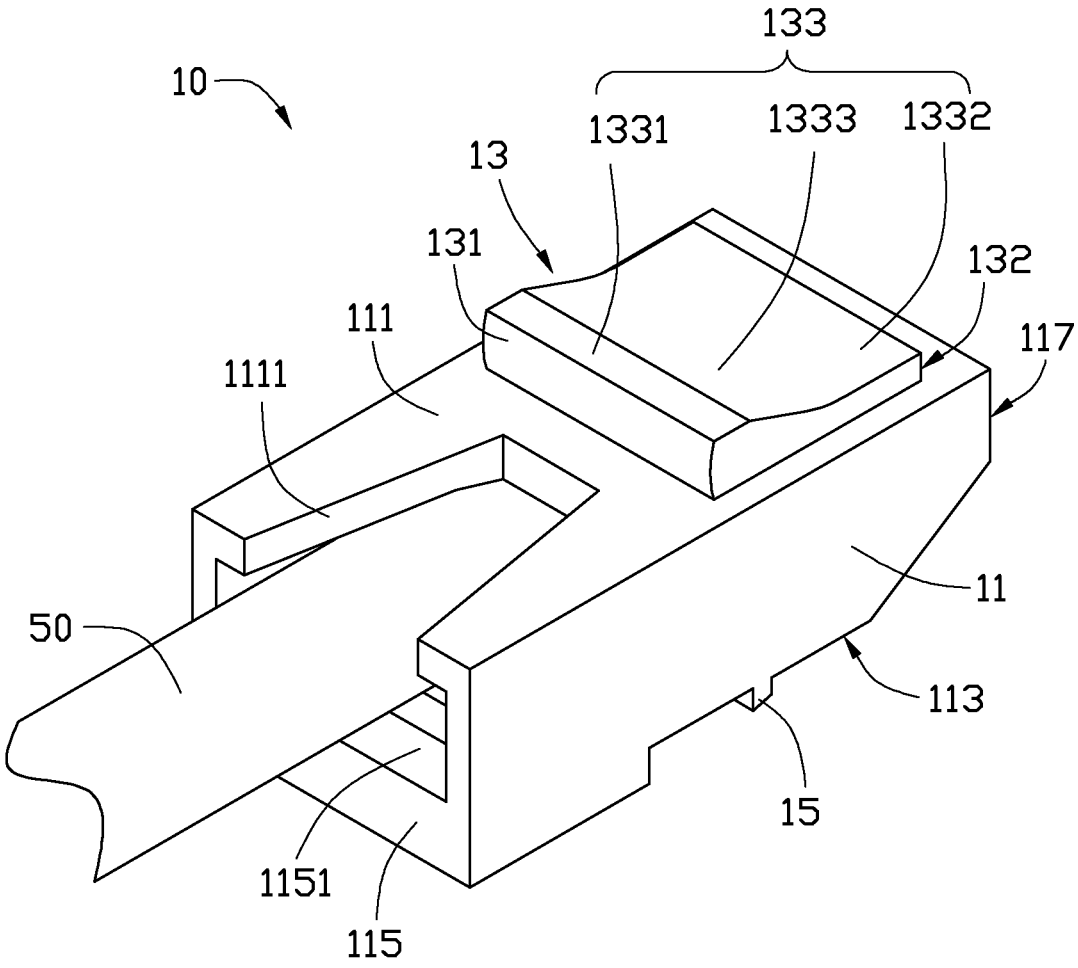
FIG. 1 is an isometric view of an exemplary embodiment of an RJ-type plug.
Figure 2:
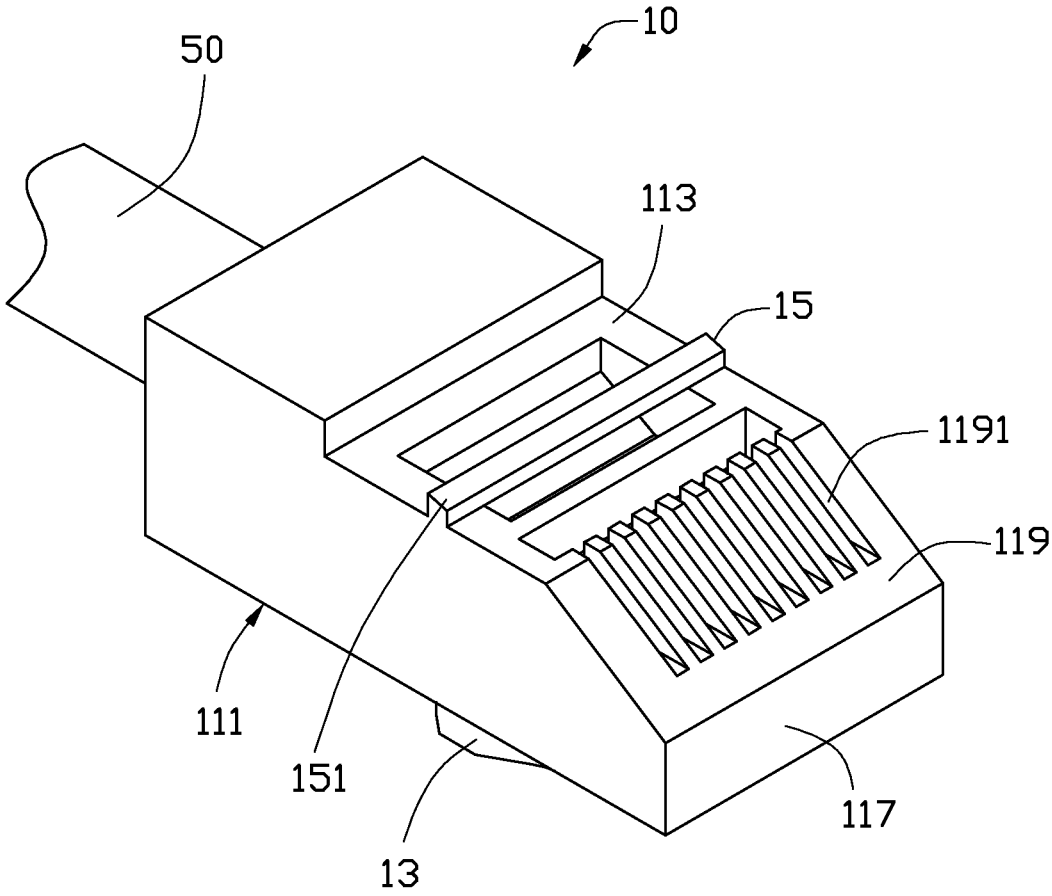
FIG. 2 is similar to FIG. 1, but showing the RJ-type plug in another aspect.
Figure 3:
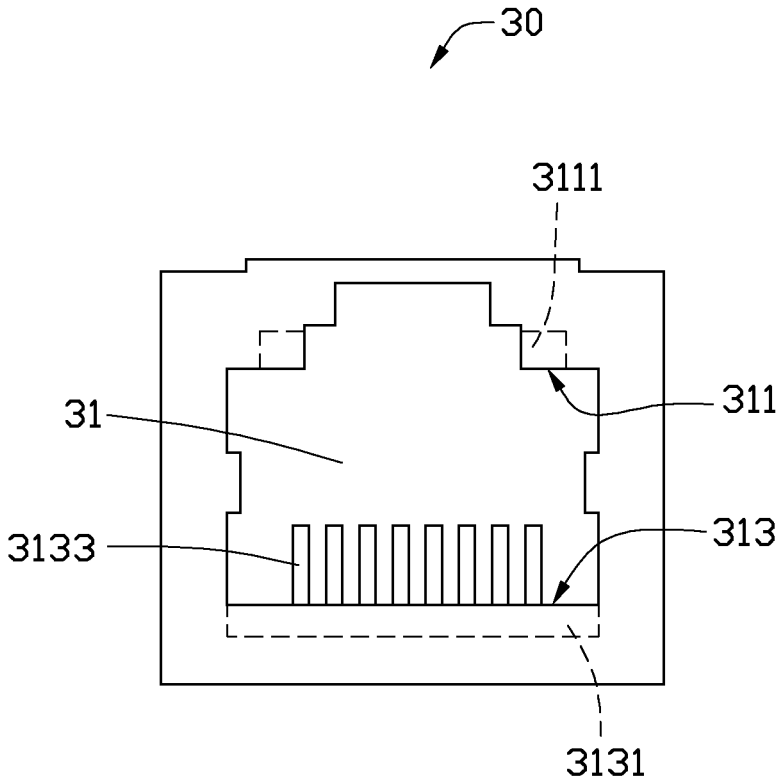
FIG. 3 is a side view of an RJ-type housing used for mating with the RJ-type plug of FIG. 1.

FIGS. 1 through 3 show an exemplary embodiment of an RJ-type plug 10 and an RJ-type housing 30. The RJ-type plug 10 is configured for inserting into the corresponding RJ-type housing 30 to form an electrical connection in data communication or telecommunication applications.

The plug 10 can be an RJ-45 plug, an RJ-11 plug, an RJ-12 plug or any other types RJ-type plugs. In the exemplary embodiment, the plug 10 is an RJ-45 plug, and has eight terminal pins (not shown). One end of the plug 10 is electrically connected to a cable 50, and the other end of the plug 10 is electrically connected to the corresponding housing 30. The housing 30 may be one portion of a terminal device, such as a computer and a telephone. The plug 10 includes a plug body 11, a latching block 13, and a latching beam 15. The latching block 13 and the latching beam 15 are configured to latch the plug 10 into the housing 30.

Referring to FIG. 2, the plug body 11 includes a first surface 111 and an opposite second surface 113. The latching block 13 and the latching beam 15 respectively protrude from the first and second surfaces 111, 113. The plug body 11 further includes a first end 115 and a second end 117. The first end 115 defines a receiving groove 1151 configured to receive the cable 50 to connect the cable 50 to the terminal pins. The first surface 111 further defines an opening 1111 adjacent to the latching block 13. The opening 1111 communicates with the receiving groove 1151 and the first end 115. When the cable 50 is pulled by a user, one portion of the cable 50 connecting the plug 10 can enter the opening 1111 to keep the pulled force from directly applied on the plug 10 and prevent the plug 10 falling out of from the housing 30.

The plug body 11 defines an inclined surface 119 on the second end 117. The inclined surface 119 defines a number of parallel pin grooves 1191, all of which communicate with the receiving groove 1151. Each pin groove 1191 receives a corresponding terminal pin accordingly.

Referring to FIG. 1, the latching block 13 is narrow than the plug body 111, and includes a resisting end 131 facing the opening 1111, a front end 132, opposite to the resisting end 131, and a guiding surface 133 connecting the resisting end 131 and the front end 132. The resisting end 131 is higher than the front end 132, and connects to the first surface 111. The guiding surface 133 includes a first plane 1331 connecting to the resisting end 131, a second plane 1332 parallel to the first plane 1331 and connecting to the front end 132, and a slope 1333 connecting the first plane 1331 and the second plane 1332. When the plug 10 is plugged into the housing 30, the guiding surface 133 guides the latching block 13 to be latched into the housing 30 until the resisting end 131 is latched in the housing 30.

Figure 4:
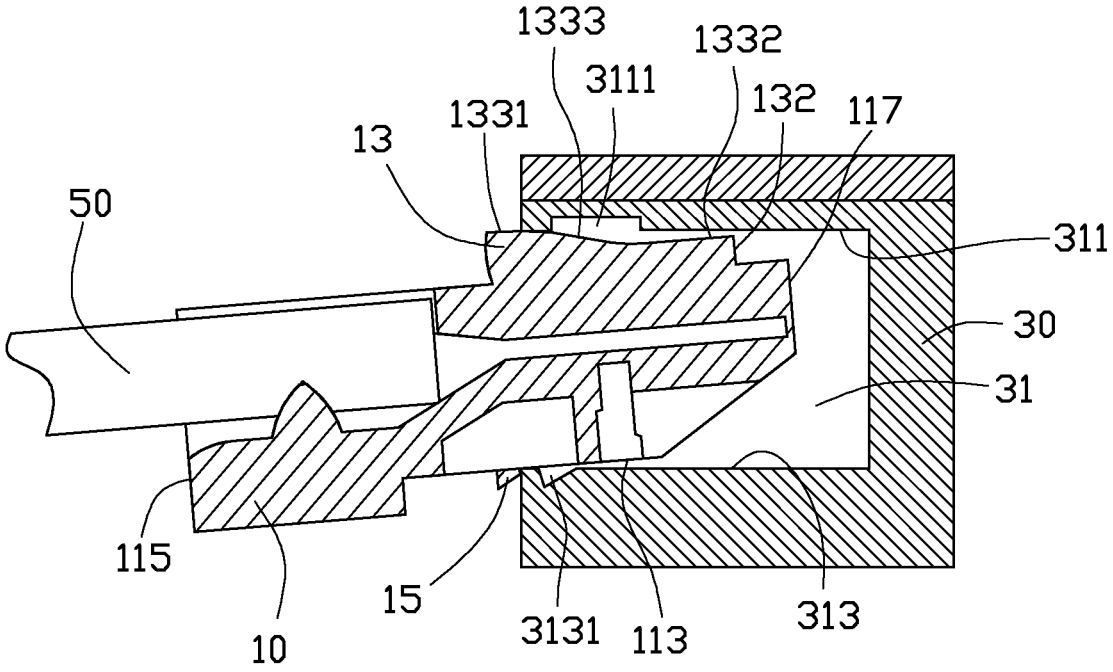
FIG. 4 is a cross-sectional view of the RJ-type plug plugged into the RJ-type housing of FIG. 3 in an initial state.

Referring to FIG. 2, the latching beam 15 is substantially a straight beam, and extends to two sides of the second surface 113. A cross-section of the latching beam 15 is substantially trapezoid-shaped, and includes a forward-facing slanted end surface 151 (FIG. 4). The latching beam 15 latches the second surface 113 of the plug 10 in the housing 30.

Referring to FIG. 3, the housing 30 defines a receiving cavity 31 cooperatively defined by a first wall 311 and an opposite second wall 313. The first wall 311 defines a latching notch 3111 receiving the latching block 13. The second wall 313 defines a latching groove 3131 receiving the latching beam 15. In the exemplary embodiment, the latching groove 3131 is substantially asymmetric V-shaped (FIG. 4). The latching beam 15 can separate from the latching groove 3131 by slipping over the wall of the latching groove 3131. A number of terminal pins 3133 are positioned on the second wall 313 corresponding to the pin grooves 1191. Each terminal pin 3133 plugged into the corresponding pin groove 1191 is electronically connected to the corresponding terminal pin in the pin grooves 1191.

Figure 5:
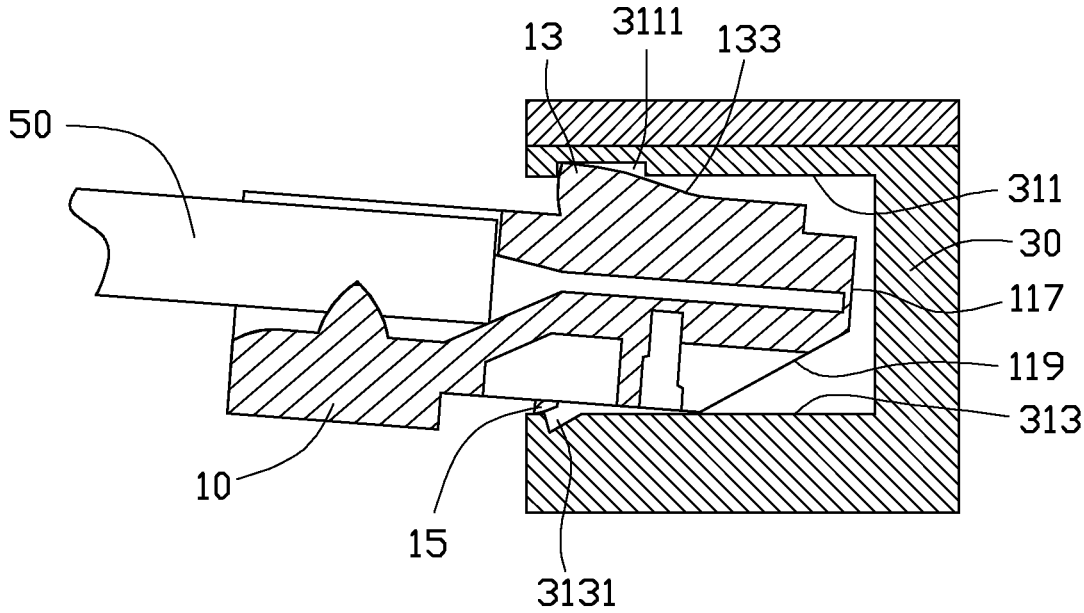
FIG. 5 is similar to FIG. 4, but showing the RJ-type plug partially latched into the RJ-type housing.
Figure 6:
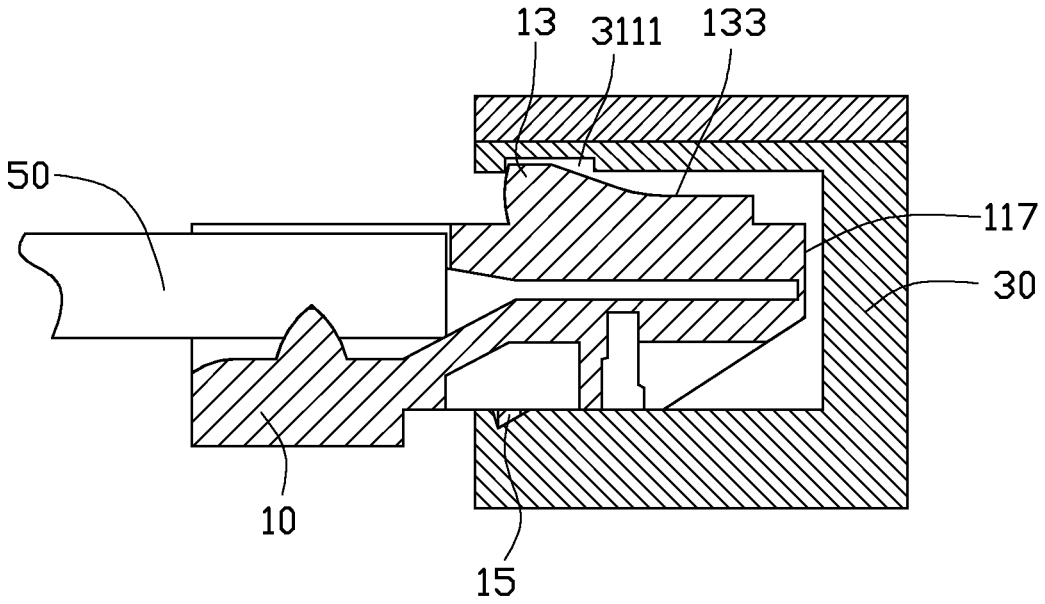
FIG. 6 is similar to FIG. 4, but showing the RJ-type plug completely received in the RJ-type housing.

Referring FIGS. 4 through 6, the plug 10 can be, but not limited to be plugged into the housing 30 in the following steps. First, the second end 117 of the plug 10 is slantingly plugged into the cavity 31, then the second plane 1332 and the slope 1333 of the guiding surface 133 are sequentially inserted into the cavity 31 until the first plane 1331 resists the first wall 311 first wall (FIG. 4). Then, the first end 115 of the plug 10 is raised up so the latching beam 15 abuts against the second wall 313 (FIG. 5), and the first plane 1331 continuously resists the first wall 311 and is deformed slightly. When the plug 10 is continuously pushed, the latching block 13 and the latching beam 15 are respectively deformed slightly until the latching block 13 and the latching beam are respectively and sequentially latched into the latching notch 3111 and the latching groove 3131 (FIGS. 5 and 6).

The plug 10 can be but is not limited to be separated from the housing 30 in the following steps. First, the first end 115 of the plug 10 is raised up so the plug 10 is slanted relative to the cavity 31. Then the plug 10 is pulled until the latching beam 15 is separated from the latching groove 3131, and abuts against the second wall 313 (FIG. 5). After that, the first end 115 is continuously pulled until the latching beam 15 is separated from the cavity 31. Then the first end 115 of the plug 10 is pushed down, the latching block 13 is deformed slightly and finally separated from the latching notch 3111 with the plug 10 is continuously pulled.

It is to be further understood that even though numerous characteristics and advantages of the exemplary embodiments have been set forth in the foregoing description, together with details of structures and functions of various embodiments, the disclosure is illustrative only, and changes may be made in detail, especially in matters of shape, size, and arrangement of parts within the principles of the exemplary invention to the full extent indicated by the broad general meaning of the terms in which the appended claims are expressed.

What is claimed is:

1. An RJ-type plug for mating with an RJ-type housing, the RJ-type plug comprising:

a plug body comprising a latching block protruding from a first surface thereof, wherein the latching block includes a resisting end connecting to the first surface, a front end opposite to and lower than the resisting end, and a guiding surface connecting the resisting end and the front end, the guiding surface is configured to guide the latching block to be latched into or be separated from a top of the RJ-type housing;

a latching beam protruding from a second surface of the plug body opposite to the first surface, the latching beam configured to latch a bottom of the RJ-type housing; and a first end between the first surface and the second surface, wherein the first end defines a receiving groove configured to receive a cable, the first surface further defines an opening communicating with the receiving groove and the first end, the opening allows one portion of the cable connecting the RJ-type plug to be inserted into the opening.

2. The RJ-type plug as claimed in claim 1, wherein the guiding surface comprises a first plane connecting to the resisting end, a second plane parallel to the first plane and connecting to the front end, and a slope connecting the first plane and the second plane.

3. The RJ-type plug as claimed in claim 1, wherein the latching block is narrow than the plug body.

4. The RJ-type plug as claimed in claim 1, wherein the latching beam is a straight beam, and extends to two opposite sides of the second surface.

5. The RJ-type plug as claimed in claim 4, wherein the latching beam is positioned at an middle portion of the second surface.

6. The RJ-type plug as claimed in claim 1, wherein a cross-section of the latching beam is trapezoid-shaped, and the latching beam comprises a forward-facing slanted end surface.

7. The RJ-type plug as claimed in claim 1, wherein the plug body further comprises a second end opposite to the first end, an inclined surface is formed on the second end, and the inclined surface defines a plurality of parallel pin grooves all of which communicate with the receiving groove.

8. A connector assembly comprising:

an RJ-type housing defining a receiving cavity having a first wall and a second wall opposite to the first wall, the first wall defining a latching notch, the second wall defining a latching groove;

an RJ-type plug detachably plugged into the receiving cavity, and comprising a plug body, the plug body comprising a first surface, an opposite second surface, a latching block protruding from the first surface, and a latching beam protruding from the second surface, wherein the latching block includes a resisting end connecting to the first surface, a front end lower than the resisting end, and a guiding surface connecting the resisting end and the front end, the guiding surface guides the resisting end of the latching block to be latched into or be separated from the latching notch, the latching beam is detachably latched into the latching groove.

9. The connector assembly as claimed in claim 8, wherein the guiding surface comprises a first plane connecting to the resisting end, a second plane parallel to the first plane and connecting to the front end, and a slope connecting the first plane and the second plane.

10. The connector assembly as claimed in claim 8, wherein the latching block is narrow than the plug body.

11. The connector assembly as claimed in claim 8, wherein the latching beam is a straight beam, and extends to two opposite sides of the second surface.

12. The connector assembly as claimed in claim 11, wherein the latching beam is positioned at an middle portion of the second surface.

13. The connector assembly as claimed in claim 8, wherein a cross-section of the latching beam is trapezoid-shaped, and the latching beam comprises a forward-facing slanted end surface, the latching groove is asymmetric V-shaped.

14. The connector assembly as claimed in claim 8, wherein the plug body further comprises a first end between the first surface and the second surface, the first end defines a receiving groove configured to receive a cable, the first surface further defines an opening communicating with the receiving groove.

15. The connector assembly as claimed in claim 14, wherein the plug body further comprises a second end opposite to the first end, an inclined surface is formed on the second end, and the inclined surface defines a plurality of parallel pin grooves all of which communicate with the receiving groove.

* * * * *